US010099343B2

(12) United States Patent
Goers

(10) Patent No.: US 10,099,343 B2
(45) Date of Patent: Oct. 16, 2018

(54) ABRASIVE DISC WITH UNIVERSAL HOLE PATTERN

(75) Inventor: Brian D. Goers, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1701 days.

(21) Appl. No.: 12/946,197

(22) Filed: Nov. 15, 2010

(65) Prior Publication Data

US 2012/0122384 A1 May 17, 2012

(51) Int. Cl.
*B24D 11/00* (2006.01)
*B24B 55/10* (2006.01)

(52) U.S. Cl.
CPC ..... *B24B 55/102* (2013.01); *B24B 55/10* (2013.01); *B24D 11/00* (2013.01)

(58) Field of Classification Search
CPC ..... B24D 11/00; B24B 55/10; B24B 55/102
USPC ..... 451/456, 527, 539
See application file for complete search history.

(56) References Cited

U.S. PATENT DOCUMENTS

| | | | | |
|---|---|---|---|---|
| 5,453,040 | A | 9/1995 | Schaal et al. | |
| 5,810,650 | A | 9/1998 | Jost | |
| 5,989,112 | A * | 11/1999 | Long et al. | 451/527 |
| 6,368,199 | B1 * | 4/2002 | Van Osenbruggen | 451/490 |
| 6,527,634 | B2 * | 3/2003 | Lee et al. | 451/548 |
| 6,743,086 | B2 * | 6/2004 | Nelson et al. | 451/527 |
| 7,108,594 | B2 | 9/2006 | Swei | |
| 7,458,884 | B2 * | 12/2008 | Falk | 451/359 |
| 2005/0202769 | A1 * | 9/2005 | Chang | 451/527 |

OTHER PUBLICATIONS

International Search Report for PCT/US2011/060532, prepared by the Korean Intellectual Property Office, dated Apr. 10, 2012.

* cited by examiner

*Primary Examiner* — Eileen Morgan
(74) *Attorney, Agent, or Firm* — Kevin W. Weber

(57) ABSTRACT

An abrasive disc for use with a sanding tool having a plurality of dust collection holes includes a hole pattern consisting of six openings arranged for substantial alignment with the dust collection holes provided in the sanding tool.

1 Claim, 3 Drawing Sheets

ABRASIVE DISC WITH UNIVERSAL HOLE PATTERN

BACKGROUND

The present invention relates generally to abrasive articles and, more particularly, to abrasive articles having a universal hole pattern for use on sanding tools having different dust collection hole patterns.

Hand-held power sanding tools, such as orbital sanders or random orbit sanders, often include dust collection systems that help collect dust generated during the sanding process. Sanding tools equipped with dust collection systems typically include a vacuum system that sucks the sanding dust through a plurality of holes, or openings, in the tool and into a bag or canister. Such sanding tools typically use abrasive discs that are removably and replaceably mounted on the tool or on a back-up pad using, for example, adhesive, hook-and-loop fasteners or other conventional attachment means. The abrasive discs contain openings that allow dust generated during the sanding process to be collected through the dust collection holes in the sanding tool. Existing sanding tools with dust collection systems come with several different hole patterns for dust collection, and abrasive discs are designed with hole patterns that generally match the sanding tool dust collection hole patterns (i.e. the abrasive disc contain openings that leave at least a portion of the dust collection holes in the sanding tool exposed so they can suck in dust).

In the U.S. retail market, there are two predominant dust collection hole patterns for sanding tools, the five hole pattern, and the eight hole pattern. FIG. 1 illustrates the mounting surface 2 of a sanding tool having the common five hole pattern. Each dust collection hole 4 has a diameter of about ⅜ inch (9.53 millimeters) that is located on about a 2.766 inch (70.26 millimeter) diameter circle. FIG. 2 illustrates the mounting surface 6 of a sanding tool having the common eight hole pattern. Each hole 8 has a diameter of about ⅜ inch (9.53 millimeters), and is located on about a 2.626 inch (66.70 millimeter) diameter circle. The mounting surface 2, 6 to which the abrasive disc is affixed may be provided as part of the sanding tool itself, or the mounting surface 2, 6 may be provided as part of an intermediate back-up pad, such as a foam or non-woven material, that is attached to the sanding tool.

Because sanding tools having different hole patterns exist in the market, abrasive disc manufacturers, wholesalers and retailers must make and/or stock discs with each pattern in all abrasive grit sizes for use with the different sanding tools. This results in increased costs, inconvenience, and stocking difficulty in trying to meet the customer's needs. In order to reduce these problems, attempts have been made to provide abrasive discs with a universal hole pattern that can be used with different dust collection hole patterns.

U.S. Pat. No. 5,989,112 (Long et. al.), for example, discloses abrasive discs for use with orbital sanders having dust extractor systems in which the discs are adapted for use with orbital sanders having different patterns and numbers of dust extractor holes.

U.S. Pat. No. 6,743,086 (Nelson et. al.) discloses a universal abrasive article adapted to mount on a mounting surface of a sanding tool having a plurality of dust collection holes that define an open area, wherein the abrasive article includes a plurality of discrete apertures that are sized and positioned so as to expose a majority of the open area of the dust collection holes independent of the angular orientation of the abrasive article when the abrasive article is in registration with the mounting surface.

SUMMARY

Known abrasive discs having universal hole patterns may be expensive and/or difficult to make, the hole patterns may have a deleterious effect on the strength of the abrasive disc and result in shortened life of the product, or they may be difficult to install on the sanding tool (i.e. it may be difficult to properly align the openings in the abrasive disc with the holes in the sanding tool/back-up pad).

The need exists for an abrasive disc having a universal hole pattern that can be used with existing dust collection systems having different dust collection hole patterns, such as the standard five and eight hole patterns described above with reference to FIGS. 1 and 2, and otherwise overcomes the shortcomings of existing abrasive discs. More particularly, it would be desirable to provide an abrasive disc having a universal hole pattern that aligns with, and therefore exposes, a sufficient percentage of the area defined by the dust collection holes in the sanding tool or back-up pad, thereby to allow the dust collection system to perform satisfactorily, that contains a minimal number of openings and includes openings having shapes that are easy to produce, thereby to simplify the manufacturing process, that requires a minimal amount of material to be removed from the abrasive disc, thereby to maintain the strength and physical integrity of the abrasive disc and provide optimal sanding performance, and that can be readily installed on the sanding tool by an end user in a manner that ensures proper alignment between the holes in the abrasive disc and the holes in the sanding tool.

The present invention provides an abrasive disc having a universal hole pattern that contains a minimal number of openings, is easy to manufacture because it uses openings having standard shapes that are easily formed into the abrasive discs, minimizes the quantity of material that must be removed from the abrasive disc, thereby maintaining the strength and physical integrity of the disc and providing optimal sanding performance, and can be readily installed by an end user on the sanding tool in a manner that ensures proper alignment between the holes in the abrasive disc and the holes in the sanding tool.

In one embodiment, the present invention provides an abrasive disc for use with a sanding tool having a plurality of dust collection holes wherein the abrasive disc includes a hole pattern consisting of six openings arranged for substantial alignment with the dust collection holes provided in the sanding tool.

In various aspects, the hole pattern may include two circular openings; the two circular openings may have different sizes; the two circular openings may be diametrically opposed; four of the openings may be non-circular, the four non-circular openings may be elongated; the four elongated openings may be defined by a pair of parallel side walls connected by symmetric arcuate ends; the arcuate ends of the elongated openings may be semi-circular; the four elongated openings may include a first pair of elongated openings having a first matching configuration, and the four elongated openings may include a second pair of elongated openings having a second matching configuration; the first pair of the elongated openings may have the same area, the second pair of elongated openings may have the same area, and the area of the first pair of elongated openings may be different from the area of the second pair of elongated openings; the area of the first pair of elongated openings may be less than the area of the second pair of elongated openings; the first circular opening may be arranged between the first pair of elongated openings; the second circular opening may be arranged between the second pair of elongated openings; an imaginary line passing through the center of the circular openings may define a line of symmetry, whereby the hole patterns on opposite sides of the imaginary line are symmetric; each opening may have a portion that is radially spaced an equal distance from a center point of the abrasive disc; the first circular opening may have a diameter of at least about 0.33 inches (7.62 millimeters-mm); the second circular opening may have a diameter of at least about 0.35 inches (8.89 mm); the first elongated openings may each have a length of at least about 0.6 inches (15.24 mm) and no greater than about 1.0 inch (25.4 mm); the second elongated openings may each have a length of at least about 1.0 inches (25.4 mm) and no greater than about 2.0 inches (50.8 mm); the radius of the semi-circular portions of the elongated openings may generally correspond to the radius of the first circular opening, and the radius of the first circular opening may be less than the radius of the second circular opening, whereby the first and second circular openings are readily visually distinguishable such that the second circular opening may serve as an alignment hole; and/or the distance between any two adjacent openings may be at least about 0.35 inches (8.89 mm).

In another embodiment, the present invention provides a circular abrasive disc for use with a sanding tool having a plurality of dust collection holes, wherein the abrasive disc comprises a symmetric hole pattern including a pair of diametrically opposed circular openings and at least one pair of non-circular openings. In one aspect, the abrasive disc may further comprise a second pair of non-circular openings, wherein the first pair of non-circular openings have a first size, and a second pair of non-circular openings have a second size different from the first size.

In a more specific embodiment, the present invention provides a circular abrasive disc comprising a first circular opening having a size that generally corresponds to the size of the dust collection holes in the sanding tool, a second enlarged circular opening arranged 180 degrees from the first circular opening, a first pair of elongated openings arranged on opposite sides of the first circular opening, and a second pair of elongated openings having a size greater than the first pair of elongated openings arranged on opposite sides of the enlarged circular opening and between the enlarged circular opening and the first pair of elongated openings.

In another embodiment, the present invention provides an abrasive disc for use with a sanding tool having a plurality of dust collection holes, the abrasive disc comprising a hole pattern having less than eight openings, and wherein at least one of the openings is circular.

Advantage of certain embodiments of the invention described herein include that it provides an abrasive disc that can be used with sanding tools and back-up pads having different dust collection hole patterns, such as the standard five hole and eight hole patterns, the abrasive disc contains a minimal number of openings, it can be easily and inexpensively produced because it contains openings having standard sizes and shapes that are easily formed into the abrasive discs, it minimizes the quantity of material that must be removed from the abrasive disc, thereby maintaining the strength and physical integrity of the abrasive disc and providing optimal sanding performance, and that it can be readily installed by an end user on a sanding tool in a manner that ensures proper alignment between the holes in the abrasive disc and the holes in the sanding tool so the dust collection system operates satisfactorily.

BRIEF DESCRIPTION OF THE DRAWINGS

The present invention will be further described with reference to the accompanying drawings, in which.

DETAILED DESCRIPTION

Figure 1:
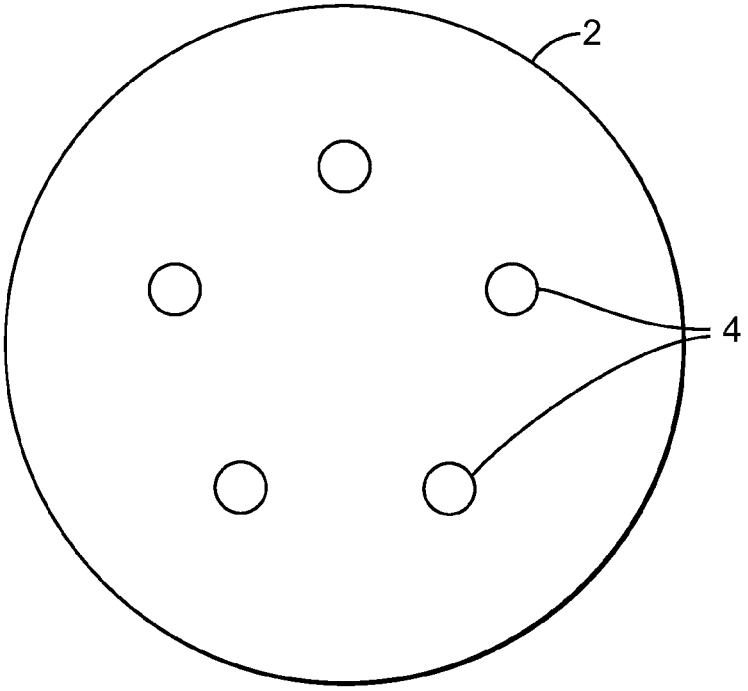
FIG. 1 PRIOR ART
FIG. 1 is a plan view of a back-up pad having a five hole dust collection system according to the prior art.
Figure 2:
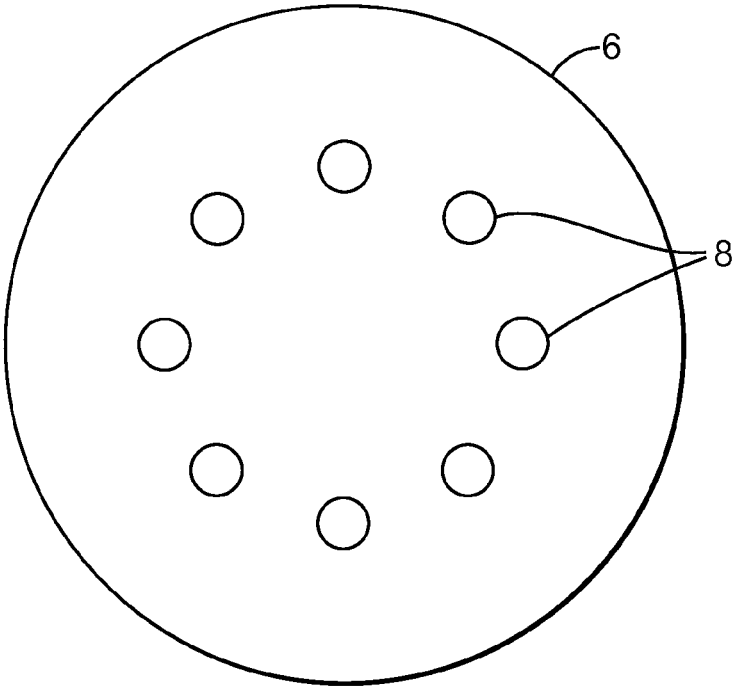
FIG. 2 PRIOR ART
FIG. 2 is a plan view of a back-up pad having an eight hole dust collection system according to the prior art.
Figure 3:
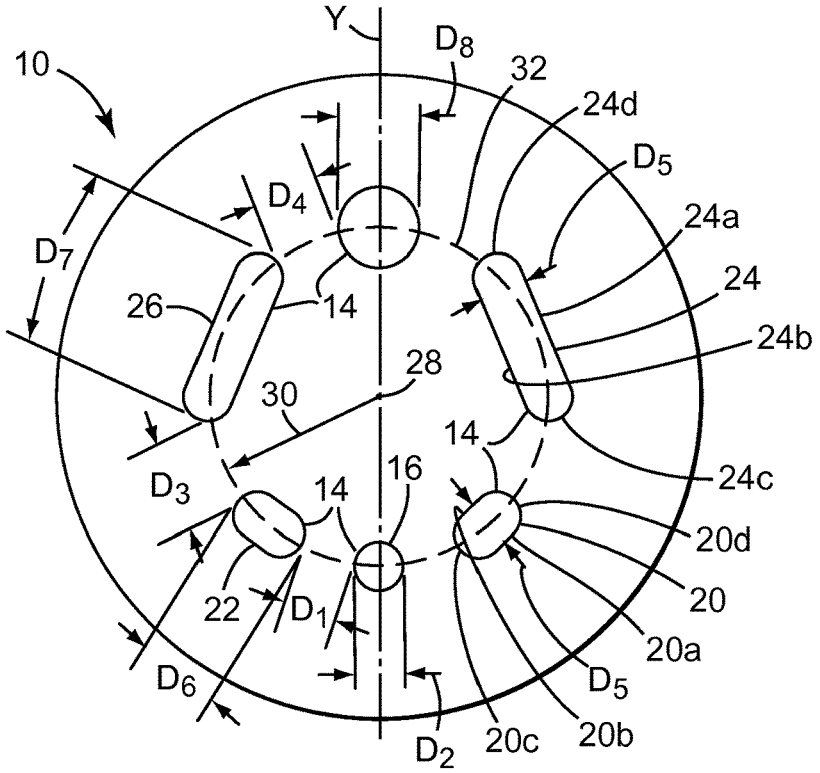
FIG. 3 is a plan view of an abrasive disc having six openings according to an exemplary embodiment of the invention.

Referring now to the drawings, wherein like reference numerals refer to like or corresponding parts throughout the several views, FIG. 3 shows an abrasive disc 10 for use with a hand-held power sanding tool having a plurality of dust collection holes 4,8 such as the five hole dust collection hole pattern shown in FIG. 1, or the eight hole dust collection hole pattern shown in FIG. 2. The abrasive disc 10 may be, for example, the standard five inch disc having a nominal five inch diameter that is commonly used with orbital or random orbit sanders.

Effective functioning of a dust collection system does not require 100 percent alignment between the openings in the abrasive disc and the dust collection holes in the sanding tool, thereby resulting in 100 percent exposure of the dust collection holes. Rather, it has been found that alignment resulting in exposure of 75 percent or greater of the dust collection hole open area is generally acceptable for efficient operation of a dust collection system.

In accordance with a characterizing aspect of the abrasive disc 10, the abrasive disc 10 is provided with a universal hole pattern 12 defined by six openings 14 that can be arranged in substantial alignment with the dust collection holes 4, 8 provided in a sanding tool or back-up pad. That is, the six openings 14 of the abrasive disc 10 can be aligned with the dust collection holes 4, 8 of the sanding tool so that at least about 75 percent of the open area of the dust collection holes 4, 8 is exposed. In this manner, the six openings 14 provide sufficient open area for the dust collection holes 4, 8 to allow the dust collection system to perform in an acceptable manner.

In the illustrated embodiment, the abrasive disc 10 hole pattern 12 consists of six openings 14 that can be arranged in substantial overlapping relation with the five or eight hole dust collection hole patterns shown in FIGS. 1 and 2. That is, the six openings 14 are configured to be aligned with dust collection holes 4, 8 of a sanding tool so that a functional amount of the dust collection holes 4,8 is exposed and available for dust collection. In the illustrated embodiment, the hole pattern 12 contains precisely six openings (i.e. no more and no less). In other embodiments, the abrasive disc 10 may include additional openings that do not materially affect the dust collecting capability of the sanding tool, such as small apertures, perforations, or openings that are not configured for alignment with the dust collection holes 4, 8 of the sanding tool, and do not otherwise impact the dust collecting capability of the sanding tool.

Referring to FIG. 3, in the illustrated embodiment, the abrasive disc 10 includes a first circular opening 16, a second circular opening 18 arranged 180 degrees from the first circular opening 16, a first pair of elongated openings 20, 22 arranged on opposite sides of the first circular opening 16, and a second pair of elongated openings 24, 26 arranged on opposite sides of the enlarged circular opening 18 and between the enlarged circular opening 18 and the first pair of elongated openings 20, 22. That is, the abrasive disc 10 includes a pair of diametrically opposed circular openings 16, 18, and four elongated openings 20, 22, 24, 26 symmetrically arranged between the circular openings 16, 18.

To ensure there is a suitable amount of material between the openings 14, the distance $D_1$ between the first circular opening 16 and the first elongated openings 20, 22 is generally at least equal to the diameter $D_2$ of the first circular opening 16. In the illustrated embodiment, the distance $D_3$ between the first elongated openings 20, 22 and the second elongated openings 24, 26, and the distance $D_4$ between the second elongated openings 24, 26 and the second circular opening 18, is generally at least 1.5 times the diameter $D_2$ of the first circular opening 16.

The six openings 14 are arranged around a center point 28 such that each opening 14 includes a portion spaced the same radial distance 30 from the center point 28. That is, the openings 14 are spaced generally equidistant from the center point 28. Or stated another way, the openings 14 are arranged so that each opening 14 is intersected by an arc having a radius 30 circumscribing the center point 28.

In the illustrated embodiment, the first circular opening 16 has a size that generally corresponds to the size of a dust collection holes 4, 8 provided in the sanding tool or back-up pad, and the diameter of the first circular opening 16 is smaller than the diameter of the second circular opening 18. In this manner, the first and second circular openings 16, 18 are readily visually distinguishable. As described hereinafter with reference to FIGS. 4 and 5, the visual distinction between the first and second circular openings 16, 18 allows the second circular opening 18 to be used as an alignment guide that ensures the abrasive disc 10 is oriented properly when it is affixed to a dust collection system having the standard five hole dust collection hole pattern.

Figure 4:
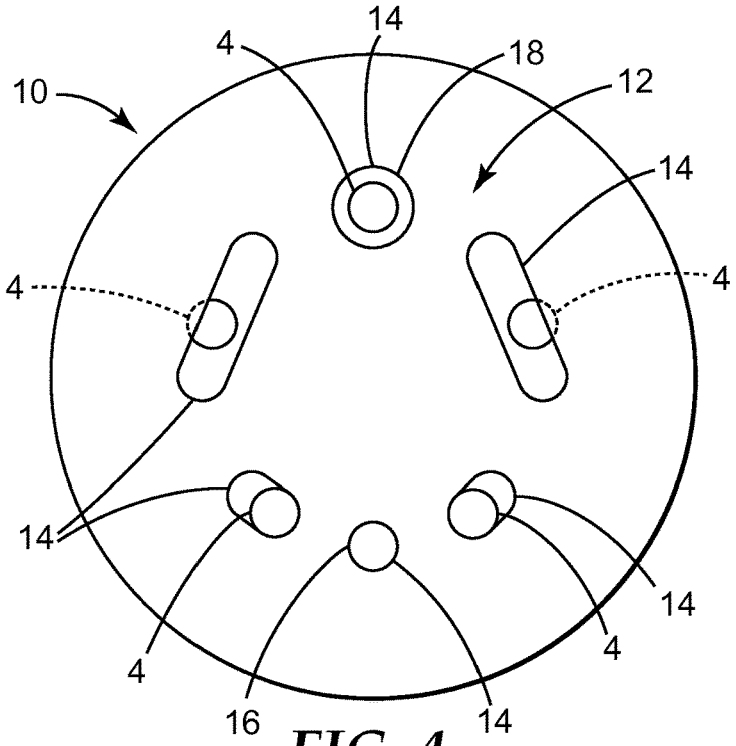
FIG. 4 is a plan view of the abrasive disc of FIG. 3 attached to a sanding tool having the five hole dust collection system of FIG. 1 such that the openings in the abrasive disc are in proper alignment with the dust collection holes in the sanding tool.
Figure 5:
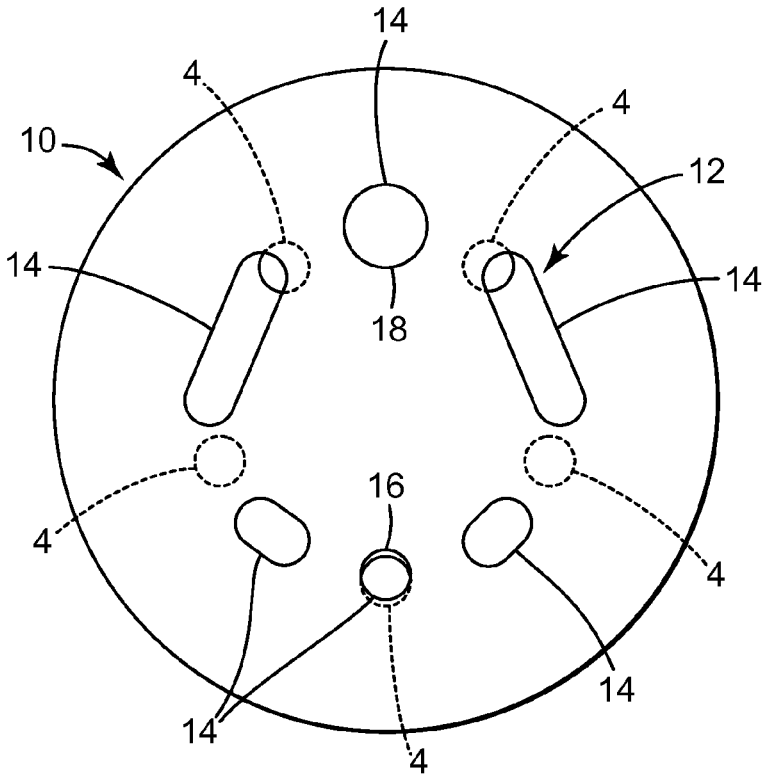
FIG. 5 is a plan view of the abrasive disc of FIG. 3 installed on a sanding tool having the five hole dust collection system of FIG. 1 such that the openings in the abrasive disc are not in proper alignment with the dust collection holes in the sanding tool.

Referring to FIGS. 4 and 5, having the circular openings 16, 18 be readily visually distinguishable allows one of the openings—is this case opening 18—to be used as a guide when the abrasive disc 10 is attached to the sanding tool, thereby ensuring proper alignment between the five holes 4 of the dust collection system illustrated in FIG. 1, and the six openings 14 in the abrasive disc 10. That is, as shown in FIG. 4—which generally illustrates the six opening hole pattern of FIG. 3 overlaying a sanding tool or back-up pad having the five hole pattern shown in FIG. 1—when the second circular opening 18 is aligned with any one of the five dust collection holes 4 in the sanding tool, the remaining openings 14 in the abrasive disc 10 will be generally aligned with the holes 4 in the sanding tool.

On the other hand, as shown in FIG. 5, if the first circular opening 16 is aligned with one of the five dust collection holes in the sanding tool (rather than the second circular opening 18), then the remaining openings in the abrasive disc 10 will be conspicuously out of alignment with the remaining duct collection holes 4 in the sanding tool. That is, the abrasive disc 10 will substantially cover, or block, the remaining four holes 4 of the dust collection system. This provides the user with an immediate indication that the abrasive disc 10 is not properly attached to the sanding tool.

Figure 6:
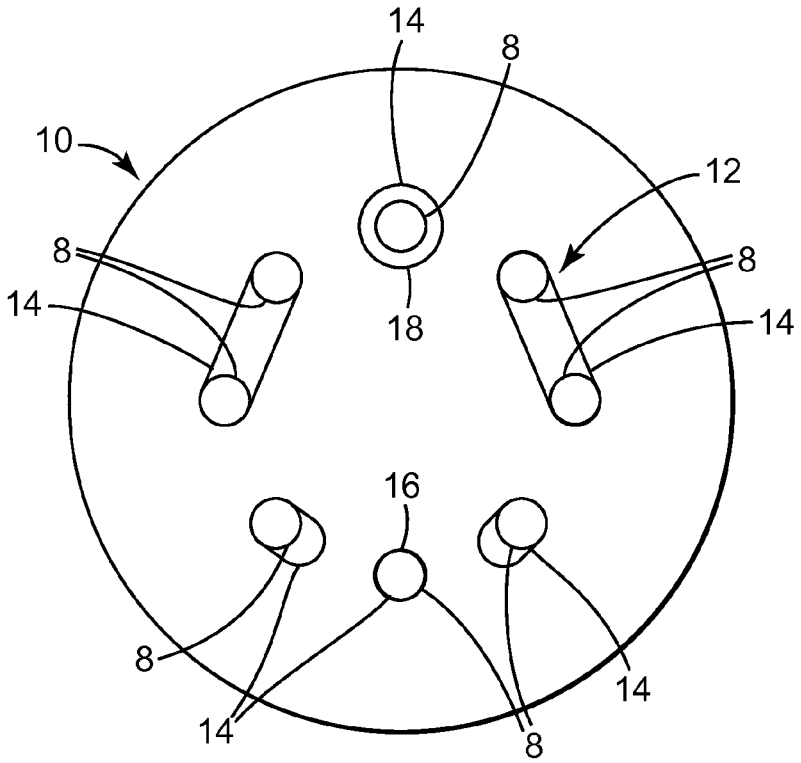
FIG. 6 is a plan view of the abrasive disc of FIG. 3 installed on a sanding tool having the eight hole dust collection hole pattern of FIG. 2.

FIG. 6 shows the abrasive disc 10 installed on a sanding tool or back-up pad having the eight hole dust collection hole pattern illustrated in FIG. 2. When installed on an eight hole dust collection system, the six opening pattern of the abrasive disc 10 allows substantially all eight holes 8 in the sanding tool/back-up pad to remain exposed. In addition, because the eight hole pattern is perfectly symmetric (i.e. it appears identical regardless of its orientation, and each hole includes a diametrically opposed hole), the abrasive disc 10 will be properly aligned with the eight hole pattern regardless of whether the first circular opening 16 or the second circular opening 18 is used to align the abrasive disc on the sanding tool/back-up pad.

Referring again to FIG. 3, in the illustrated embodiment, the hole pattern 12 is symmetric about an axis Y defined by a line drawn between the center of each of the first and second circular openings 16, 18. The first pair of elongated openings 20, 22 have generally matching geometries (i.e. similar, or identical, sizes and shapes). In addition, the second pair of elongated openings 24, 26 have generally matching geometries. However, the geometry of the first pair of elongated openings 20, 22 differs from the geometry of the second pair of elongated openings 24, 26. That is, the first pair of the elongated openings 20, 22 have the same area, and the second pair of elongated openings 24, 26 have the same area, but the area of the first pair of elongated openings 20, 22 is less than the area of the second pair of elongated openings 24, 26. More specifically, the second elongated openings 24, 26 are generally at least two times as long as the first elongated openings 20, 22.

Each of the elongated openings 20, 22, 24, 26 may be provided in a variety of noncircular shapes and sizes suitable to provide the desired degree of overlap with the dust collection holes 4, 8 in the sanding tool. However, for ease of production, it is generally desirable that each of the elongated openings 20, 22, 24, 26 have a relatively simple shape, such as the rectangular body with arcuate ends shown. More particularly, each of the first elongated openings 20, 22 include parallel side walls 20*a*, 20*b* and symmetric arcuate ends 20*c*, 20*d* in the form of semi-circles. (For simplicity, only first elongated opening 20 and second elongated opening 24 are shown and described in detail, it being understood that first elongated opening 22 and second elongated opening 26 are similar to elongated openings 20 and 24, respectively). Similarly, second elongated opening 24 included parallel side walls 24*a*, 24*b* and symmetric arcuate ends 24*c*, 24*d* in the form of semi-circles.

In more specific aspects, the abrasive disc 10 may have a first circular opening 16 having a diameter $D_2$ of at least about 0.33 inches (7.62 mm), at least about 0.35 inches (8.89 mm), or at least about 0.37 inches (9.4 mm), and a diameter $D_2$ of no greater than about 0.4 inches (10.16 mm), no greater than about 0.45 inches (11.43 mm), or no greater than about 0.5 inches (12.7 mm). The second circular opening 18 may have a diameter $D_8$ of at least about 0.35 inches (8.89 mm), at least about 0.4 inches (10.16 mm), or at least about 0.45 inches (11.43 mm), and a diameter $D_8$ of no greater than about 0.8 inches (20.32 mm), no greater than about 0.7 inches (17.78 mm), or no greater than about 0.6 inches (15.24 mm). The first pair of elongated openings 20, 22 may have a length $D_6$ of at least about 0.5 inches (12.7 mm), 0.55 inches (13.97 mm), 0.6 inches (15.24 mm), and a length $D_6$ of no greater than about 1.0 inches (25.4 mm), 0.9 inches (22.86 mm), 0.8 inches (20.32 mm). The second pair of elongated openings 24, 26 may have a length $D_7$ of at least about 1.0 inches (25.4 mm), at least about 1.2 inches (30.48 mm), or at least about 1.3 inches (33.02 mm), and a length $D_7$ of no greater than about 2.0 inches (50.8 mm), no greater than about 1.7 inches (43.18 mm), or no greater than about 1.6 inches (40.64 mm).

Persons of ordinary skill in the art may appreciate that various changes and modifications may be made to the invention described above without deviating from the inventive concept. For example, in the embodiments shown and described herein, the abrasive disc was depicted as a five inch circular disc. Other sizes and shapes, however, are considered within the slope of this disclosure. Thus, the scope of the present invention should not be limited to the structures described in this application, but only by the structures described by the language of the claims and the equivalents of those structures.

What is claimed is:

1. A circular abrasive disc adapted for use with a first sanding tool having five dust collection holes and for use with a second sanding tool having eight dust collection holes, the circular abrasive disc defining precisely six openings, the six openings comprising a first circular opening having a size that generally corresponds to a size of a dust collection hole provided in a sanding tool or back-up pad, a second enlarged circular opening arranged 180 degrees from the first circular opening, a first pair of elongated openings arranged on opposite sides of the first circular opening, and a second pair of elongated openings having a size greater than the first pair of elongated openings arranged on opposite sides of the enlarged circular opening and between the enlarged circular opening and the first pair of elongated openings, wherein a major axis of a first one of the second pair of elongated openings intersects a major axis of a second one of the second pair of elongated openings at a location adjacent the second enlarged circular opening in a direction opposite the first circular opening.

* * * * *